US005216865A

United States Patent [19]

LaLonde et al.

[11] Patent Number: 5,216,865

[45] Date of Patent: Jun. 8, 1993

[54] LOCKING CONNECTOR FOR SUSPENSION CEILING SYSTEMS

[75] Inventors: Paul D. LaLonde, Avon; James J. Lehane, Columbia Station, both of Ohio

[73] Assignee: USG Interiors, Inc., Chicago, Ill.

[21] Appl. No.: 919,718

[22] Filed: Jul. 24, 1992

[51] Int. Cl.[5] ..... E04C 2/42

[52] U.S. Cl. ..... 52/667; 403/347; 403/346

[58] Field of Search ..... 403/347, 346; 52/667

[56] References Cited

U.S. PATENT DOCUMENTS

| | | | |
|---|---|---|---|
| 4,108,563 | 8/1978 | Brown et al. | 403/347 |
| 4,462,198 | 7/1984 | Sharp | 52/667 |
| 4,494,350 | 1/1985 | Sharp | 403/347 X |

*Primary Examiner*—Andrew V. Kundrat

*Attorney, Agent, or Firm*—Pearne, Gordon, McCoy & Granger

[57] ABSTRACT

An end connector structure for suspension ceiling grid systems provides a connector to connector lock on each side of the web of a through runner. The lock includes a lateral tear drop shaped protrusion providing a rearwardly facing exposed edge in combination with a lateral strap on an associated identical connector which also provides a rearwardly facing exposed edge. When tensile stresses are applied between the two connectors, the connector to connector lock is subjected to forces causing the associated rearwardly facing edges to engage and resist connector separation. The protrusion joins the adjacent portion of the connector material with bends having relatively large radius of curvature to reduce the weakening of the structure of the protrusion resulting from notch sensitivity. These large radius of curvatures result in substantially improved ultimate strength in the connector to connector lock when compared with protrusions formed with relatively sharp bends.

6 Claims, 4 Drawing Sheets

LOCKING CONNECTOR FOR SUSPENSION CEILING SYSTEMS

BACKGROUND OF THE INVENTION

This invention relates generally to suspension ceiling systems, and more particularly, to a novel and improved connector structure which is capable of withstanding high tensile stresses without connector failure.

PRIOR ART

The present invention is an improvement upon the connector structure described and claimed in the U.S. Pat. No. 4,108,563. Such patent is assigned to the assignee of the present invention and is incorporated herein in its entirety as illustrative of what is believed to be the closest prior art to the present invention.

The end connector of the '563 patent provides a connector structure mounted on the ends of inverted tee-shaped runners at intersections formed in the grid system. Usually, an end connector is inserted from opposite sides of a through-runner opening in the web of the through-runner.

The connector contains a first-end-in-lock which provides a connection with the through-runner when a single connector is inserted through the opening in the through-runner web. The connection also provides a connector-to-connector lock when two connectors are inserted from opposite sides through a single opening in the through-runner. This connector-to-connector lock provides substantial strength to resist tensile loads which can occur during seismic activities occurring, for example, during earth quakes.

The design of the '563 patent has, when formed of relatively hard, high-strength steel with relatively low notch sensitivity, provided a strong commercially satisfactory connector-to-connector lock. However, the tensile strength provided by the connector-to-connector lock tends to decrease when the connector is formed of metals of lesser strength properties or with higher notch sensitivity.

Under tension loading of the design of the '563 patent, a strap portion formed on the end of each of the two connectors extending through the through-runner opening and engage an associated rearwardly facing edge of a tear drop shaped protrusion formed in the associated connector. In one illustrated embodiment of such '563 patent, the strap portion and protrusion interfit to prevent lateral separation. In such embodiment, high tensile strength connector-to-connector locks tend to exist, even when misalignment exists between the connectors. However, when sufficient tensile load is applied to cause failure of the connector-to-connector lock, the material adjacent to the ends of the exposed edges of the protrusion are penetrated, and the tear drop shaped protrusion tears back, causing failure of the connector-to-connector lock.

When the design of the tear drop protrusion subjected to tensile loading is formed from steels, such as Martinsitic steel, which have relatively low notch sensitivity, high strength connections are provided. This is true even though the protrusion adjoins the adjacent material of the connector for the relatively sharp bend providing a small radius of curvature.

However, if the connector is formed of other metals having relatively high notch sensitivity, the sharp bend along the material forming the protrusion subjected to high tensile loading and the adjacent connector material, such sharp bends tend to produce weaknesses which substantially reduce the ultimate strength of the connector-to-connector lock.

It is also believed that if the grain structure of the material forming the connector is substantially parallel to the sharp bend adjacent to the open end of the tear drop shaped protrusion, a weakened condition can also occur.

SUMMARY OF THE INVENTION

In accordance with the present invention, the shape of the tear drop protrusion which is subjected to tensile loading is modified so that high strength characteristics can be obtained when the connector is formed of a material having a relatively high notch sensitivity. In accordance with this invention, the improved characteristics of the connector-to-connector lock are achieved by forming the tear drop shaped protrusion subjected to tensile stresses so that the radius of curvature of the protrusion within the protrusion itself and along the zone where the protrusion joins the adjacent connector material are formed with a relatively large radius of curvature. It has been discovered that with this relatively minor change in the structure of the connector illustrated in the '563 patent, a high tensile strength connector-to-connector interlock can be obtained when the connectors are formed of materials which have relatively high notch sensitivity and which are, in many cases, lower in cost than the metals required to achieve high tensile strength connections in accordance with the disclosure of the '563 patent.

In addition, the shape of the tear drop shaped protrusion subjected to tensile loading is also modified to provide an edge along the open end thereof which is not uniform in curvature. This tends to result in a locking edge which is somewhat narrower than the corresponding edge in the prior art and appears to further improve the strength and reliability of the connection.

These and other aspects of this invention are illustrated in the accompanying drawings and are more fully described in the following specification.

DETAILED DESCRIPTION OF THE DRAWINGS

Figure 1:
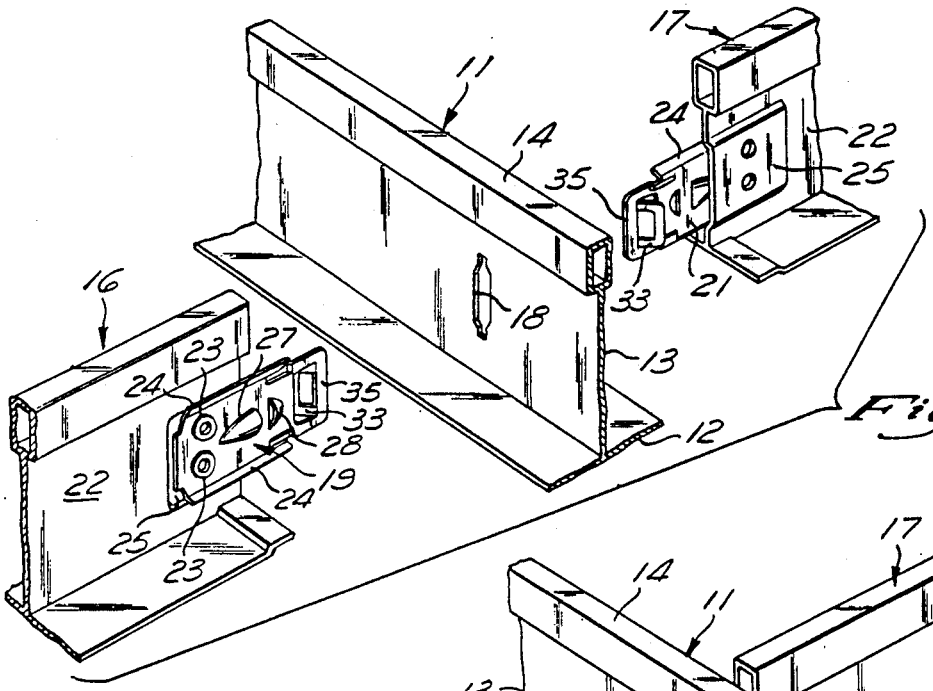
FIG. 1 is a perspective view of a portion of a through runner member and the ends of associated cross members before the end connectors are inserted into the web opening of the through runner.
Figure 2:
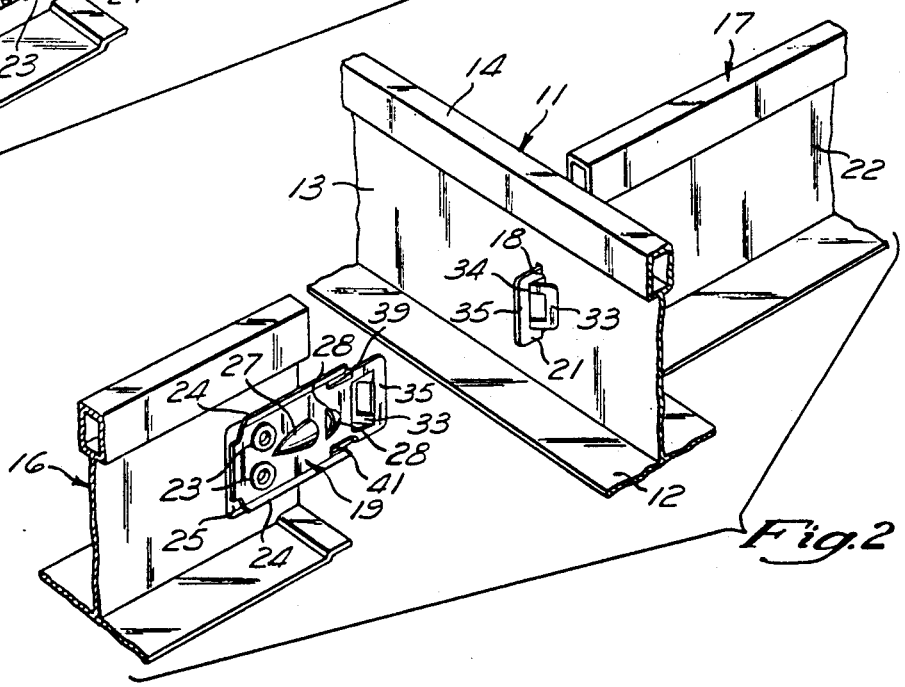
FIG. 2 is a perspective view similar to FIG. 1, illustrating a point in the assembly in which the first connector is moved into the installed position, but the second connector remains uninstalled.
Figure 3:
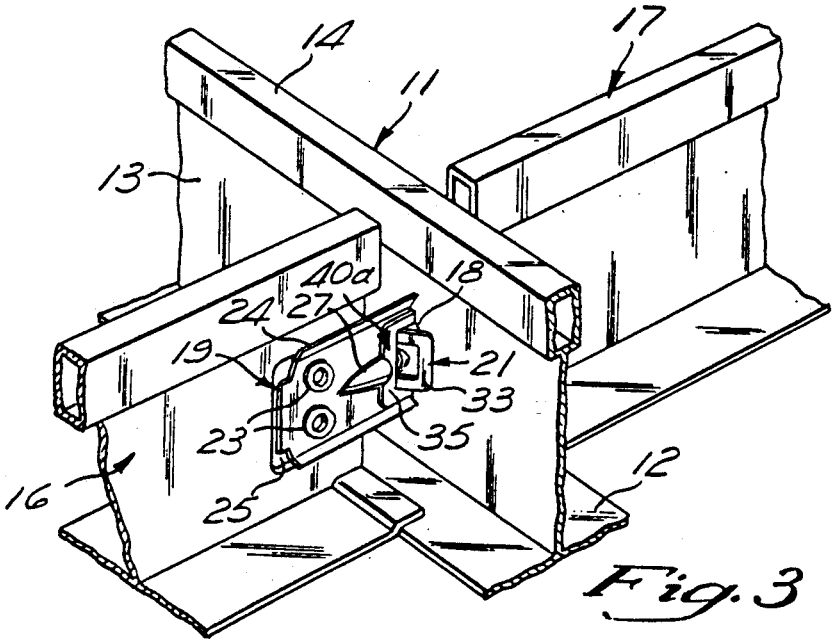
FIG. 3 is a perspective view similar to FIGS. 1 and 2, illustrating both end connectors in the fully installed position.

FIGS. 1-3 illustrate the steps in the assembly of a preferred suspension ceiling grid structure, in accordance with the present invention. Only a single junction or connection is illustrated in the drawings for purposes of clarity. However, it should be understood that in a complete grid system, including a plurality of parallel main runs, a plurality of cross members extend laterally between and are supported at their ends by the adjacent main run members. After installation, lateral runs perpendicular to the main runs are provided by aligned cross members.

The present invention is also applicable to grid structures of the basket weaved type where through-runners extend through intersections, and end connectors formed on the through-runners are installed on opposite ends of the through-runner in the same manner illustrated and described.

In the drawings, a segment of a main runner 11 is illustrated having an inverted T-shaped section with a horizontally extending flange 12 extending from opposite sides of a central web 13. A box-like bulb section 14 is formed on the upper edge of the web 13. Also illustrated are a pair of cross members 16 and 17 which are assembled on the main runner 11 from opposite sides in the manner described below. Normally, the cross section of the cross members is similar to or identical with the cross section of the main runner 11. The shape of the members 11, 16 and 17 may be produced in any one of a number of ways, such as by extrusion, forming of sheet stock, or by other suitable means. Since the manner of forming the members themselves forms no part of this invention, they have been illustrated as single wall structures for purposes of simplification.

A slot-like opening 18 is formed in the web 13 of the main member to receive an end connector 19 mounted on the cross member 16 in face-to-face relationship with an end connector 21, provided on the end of the cross member 17. The two end connectors 19 and 21 are identical in structure so the structural detail of only one should be understood to apply to the other, and similar reference numerals are used to designate similar parts on each end connector.

The end connector 19 is a stamped part formed of sheet metal stock as a separate stamping and is mounted on the web 22 of the cross members 16 by rivet-like projections 23. It should be understood, however, that if desired, the end connector could be formed of the web material of the cross member 16 and not as a separate part. The end connectors 19 and 21 are mounted in offset portions 25 in the web of the cross members 16 and 17 so that the engaging faces of the assembled connectors are aligned with the central plane of such webs to insure alignment of the connected cross members.

Figure 4:
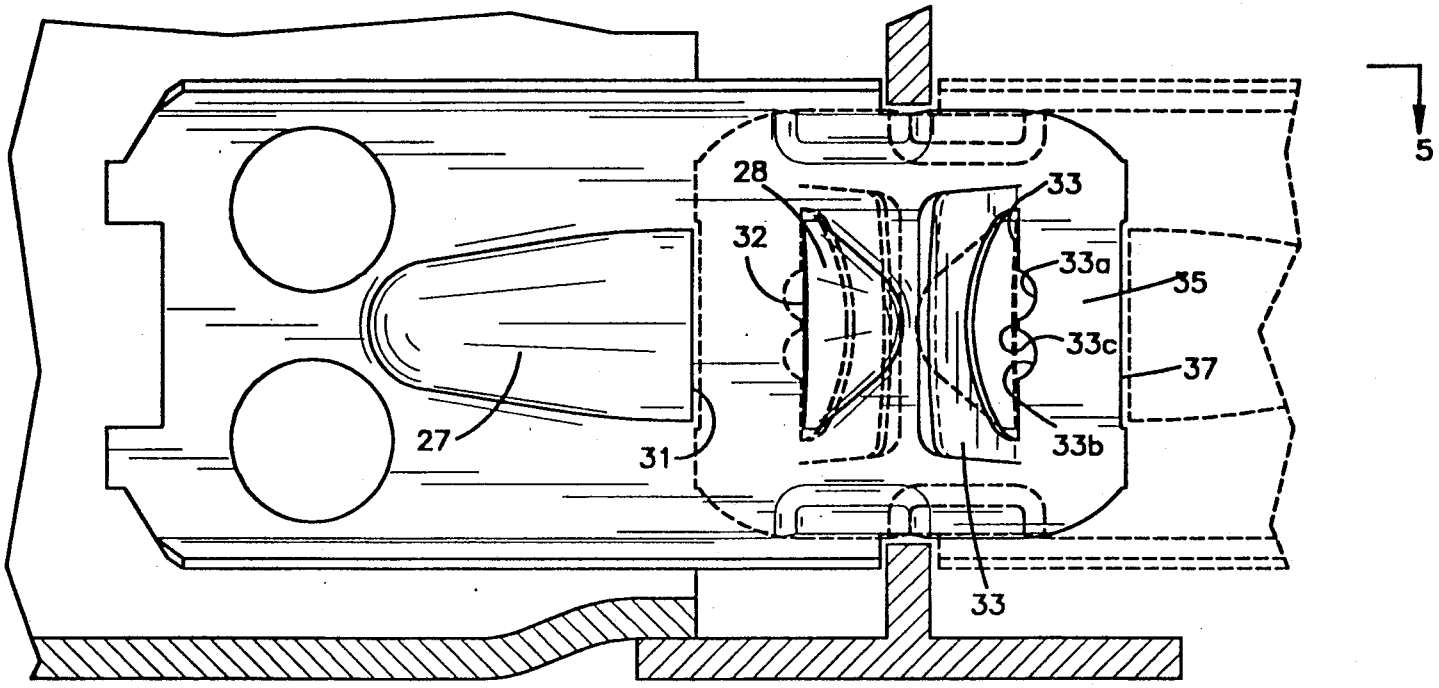
FIG. 4 is an enlarged side elevation of the end connector illustrated in FIGS. 1–3 with the associated connector illustrated in phantom.
Figure 5:
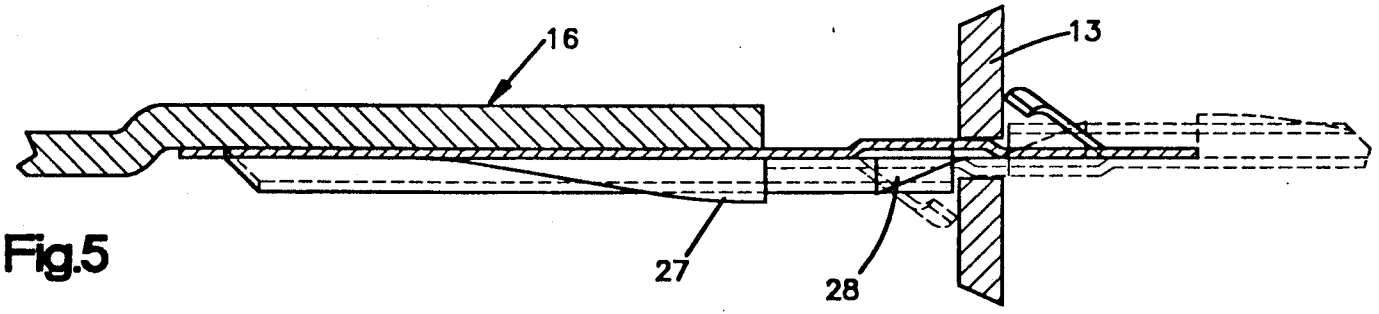
FIG. 5 is a plan view taken along 5—5 of FIG. 4 with a mating connector illustrated in phantom in the installed position.

In FIG. 4, one of the connector parts is illustrated in enlarged side elevation, and a mating part is illustrated in phantom. The connector 19 is provided with a pair of spaced tear drop shaped protrusions 27 and 28 which provide spaced opposed edge surfaces 31 and 32.

A tab is formed adjacent to the end of the connector which functions provide a first-end-in-lock when a single connector is inserted through the opening 18 in a through-runner. This tab is deflected inwardly as it passes through the opening and subsequently engages the remote side of the web adjacent to the through-runner opening. A strap section 35 provides a second surface 37 which is engageable with the surface 31 of the mating part. The surface 33 of the strap 35 is provided with two cut-off sections **33*a* and 33*b*. These cut-offs are essentially semi-circular in shape and are spaced from each other by a projection or tongue 33*c*. The end of the tongue 33*c* is aligned with the remaining portions of the first surface 33, and the various elements are proportioned so that when the two parts are connected and are in direct alignment, as illustrated in FIG. 4 by the phantom illustration, the portions of the first surface 33 outwardly of the two cut-outs 33*a* and 33*b* engage the mating surface 32 when the parts are subjected to tensile loading tending to cause separation. If significant tensile forces are applied to the connected parts, the load on the connection causes the material forming the connection to deform a limited amount with the result that the tongue 33*c* projects into the socket formed by the protrusion and prevents lateral displacement of the strap. Consequently, even under straight or aligned conditions, it has been found that this structure is capable of withstanding materially greater separation forces because an interlocking or interengaging structure is provided to prevent lateral separation between the edge 32 of the protrusion 28 and the strap 35**. In fact, the connection fails only when sufficient load is applied to actually tear or mutilate the connecting parts.

By providing the interlocking tongue-like projection **33*c*, the connection is also effective to resist tensile forces applied, even when the connectors are moved to angulated positions with respect to each other and are not in alignment. Such a condition normally does not occur unless the building in which the system is installed is subjected to very unusual forces which might occur during an earthquake or other unusual conditions, such as fire or explosions. In an angulated position, the strap 35 of the cross member connectors pivot with respect to each other, causing the tongue-like projection 33*c* of each connector to extend into the opening provided by the associated edge 32 of the protrusion 28. Consequently, both connector-to-connector locks are interlocked to prevent lateral separation of the connector-to-connector lock, and high tensile strength remains. Here again, even in the angulated position, the connector-to-connector lock fails only when sufficient force is applied to tear back the protrusion 28 or mutilate the strap 35** associated therewith.

Figure 8:
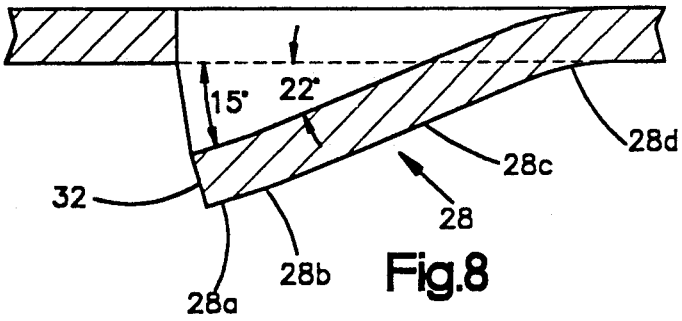
FIG. 8 is an enlarged fragmentary section taken along 8—8 of FIG. 7.
Figure 6:
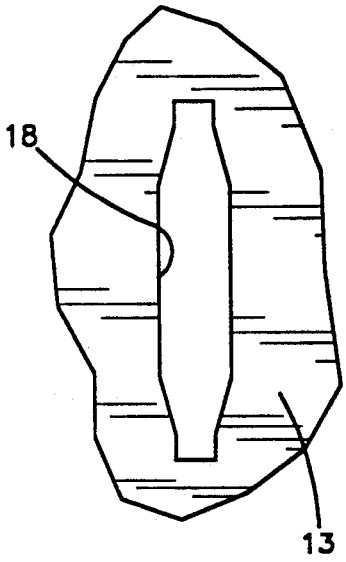
FIG. 6 is an enlarged fragmentary view showing the shape of a slot-like opening in the through-runner web into which the connectors are inserted.

With this invention, improved tensile strengths are achieved, even when the connector is formed with material having a relatively high notch sensitivity. This improved strength is achieved by modifying the shape of the protrusion 28 compared to the corresponding protrusion illustrated in the '563 patent. As illustrated in FIG. 8, the protrusion 28 is formed with an end portion **28*a* adjacent to the edge 32 which forms an angle of about 15° with respect to the plane of the connector proper and is substantially straight. From the location 28*b*, the protrusion is formed with a relatively straight section 28*c* angulated with respect to the plane of the remaining portions of the connector at an angle of about 22°. At its outer end, the protrusion 28 is blended into the adjacent portion 19*a* of the remaining portion of the clip with a relatively smooth radiused bend 28*d***.

Figure 7:
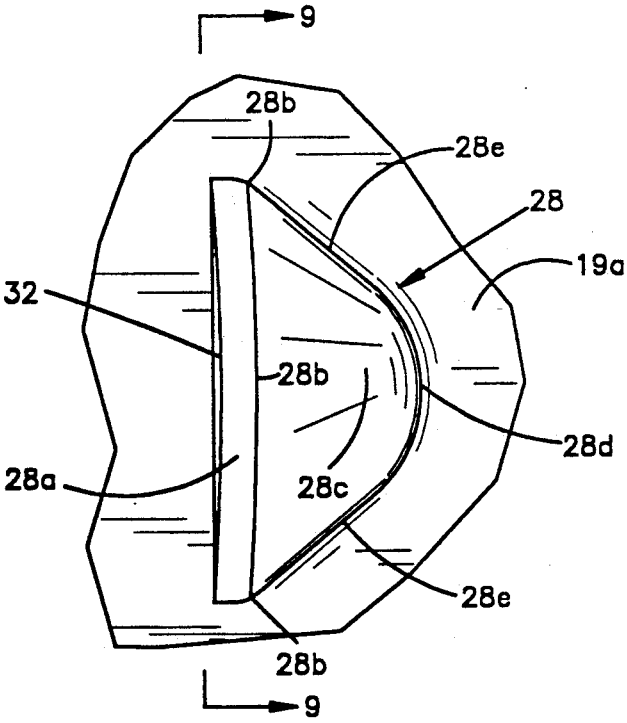
FIG. 7 is an enlarged fragmentary side elevation of the tear drop shape protrusion subjected to tensile loading.
Figure 9:
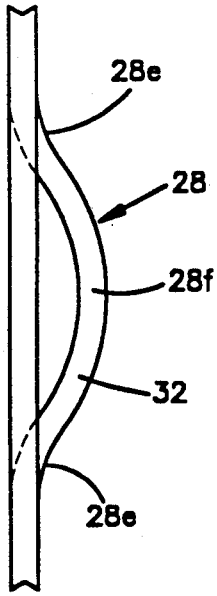
FIG. 9 is a fragmentary section taken along 9—9 of FIG. 7.

Referring now to FIG. 7, the portion **28*c* extending forwardly from the location 28*b* joins with the adjacent portion 19***a* of the connector along opposed and converging bend lines 28*e* which are substantially straight and extend from the location 28*b* to the curved bend line 28*d*. As best illustrated in FIG. 9, the bend lines 28*e* are formed with a relatively large radius of curvature, and the curvature at the top of the opening of the edge 32 at 29*f* is also formed with a relatively large radius of curvature. Here again, the provision of relatively large radius of curvature along the various bend lines improves the strength of the connection to resist tensile loading, even when the material formed in the connector is formed of relatively high notch sensitivity material. For example, by changing the shape of the protrusion 28 from the shape illustrated in the '563 patent to the shape disclosed and claimed herein, connectors formed of HSLA (high strength low alloy) steel exhibited improved connector strength in tension of slightly more than thirty percent. For example, a tensile strength of the prior art configuration formed of HSLA was between 250 and 270 lbs. However, with the configuration change illustrated herein, the connection strength fell within the range of 340 to 350 lbs. In both cases, the clips were formed of HSLA 0.016 inches thick.

The radius of curvature at 28*e* was about 0.11 inches, and the radius of curvature along the outermost extreme portion of the protrusion at 28*f* was about 0.094 inches. Further, the radius of curvature at 28*d* was about 0.05 inches, and the total width of the protrusion was about 0.24 inches. With the present invention, the protrusion 28 which is subjected to the tensile loading and which provides a critical connector-to-connector lock under seismic conditions must be formed so that the various radius of curvatures do not cause excessive weakening of the connection for a material of a given notch sensitivity. For example, if the material tends to have a higher notch sensitivity, higher or larger radius of curvatures will tend to maximize the ultimate strength of the connector-to-connector lock as it resists tensile loading. It is also believed that with this invention in which the radius of curvatures are relatively large, the direction of the grain structure of the material forming the connector is less critical.

Although the preferred embodiments of this invention have been shown and described, it should be understood that various modifications and rearrangements of the parts may be resorted to without departing from the scope of the invention as disclosed and claimed herein.

What is claimed is:

1. A locking connection for suspension ceiling grid systems which include a plurality of elongated parallel first grid members and a plurality of elongated second grid members extending substantially perpendicular to said first grid members, said intersections comprising through grid members having a web formed with an opening therein and a pair of aligned and opposed grid members having substantially planar end connections extending in opposite directions through said opening, said connectors providing a connector-to-connector lock on each side of said opening operable to resist tensile forces tending to cause substantially axial separation of said opposed grid members, each connector-to-connector lock including a protrusion providing an exposed first rearwardly facing edge extending laterally from the adjacent planar portion of said connector, each connector-to-connector lock also including an associated lateral strap on the associated connector providing a second rearwardly facing edge engaging the associated first edge in resisting axial separation between said connectors when tensile forces are applied thereto, the material of said protrusion adjacent said first rearwardly extending edge joining the adjacent metal of said connector by a radius of curvature that is at least five times the thickness of the material forming said connectors to reduce low value tensile failures.

2. A locking connector as set forth in claim 1, including means causing axial interfitting of associated first and second edges when said connector-to-connector locks are subjected to tensile forces, said axial interfitting preventing lateral separation between said first and second edges.

3. A locking connector as set forth in claim 1, wherein said protrusion provides a first portion adjacent said first edge angulated relative to the plane of said connector at a smaller angle than a second portion extending between said first portion and the forward end of said protrusion.

4. A locking connector as set forth in claim 1, wherein said protrusion joins the adjacent portion of said connector along a bend line extending along first bend portions substantially axially from said first edge to second bend portions which are substantially straight and converge to a curved third bend portion joining the inner edges of said second bend portions.

5. A locking connector as set forth in claim 1, formed of HSLA steel substantially 0.016 inches thick, and said radius of curvature adjacent the ends of said first edge is at least about 0.1 inches.

6. An end connector for suspension ceiling grid systems having intersections including a through-runner formed with the web with an opening therein and opposed and aligned grid members extending substantially perpendicular to said through member, said end connector being formed of metal having notch sensitivity causing weakness therein when sharp bends are formed therein, each connector comprising a generally planar portion having a lateral protrusion formed therein providing a rearwardly facing first exposed edge and a lateral end strap providing a rearwardly facing second edge, said connectors cooperating when two connectors are inserted in opposite directions through said opening to provide a connector-to-connector lock on each side of said web of said through-runner, said connector-to-connector locks each including interengaging associated first and second rearwardly facing edges when tensile forces are applied to said end connectors, the material of said protrusion adjacent to the ends of said first edge joining the adjacent material of said end connector having a radius of curvature sufficiently large to prevent substantial weakness resulting from notch sensitivity of the material forming said connector and substantially increasing the ultimate strength of the connector-to-connector lock which would result from a similar connector formed with sharp bends at such locations.

* * * * *